US005613801A

United States Patent [19]

Allen

[11] Patent Number: 5,613,801

[45] **Date of Patent: *Mar. 25, 1997**

[54] HIGH PERFORMANCE TWIN ENGINE ROTOR-STEERED RIDING TROWEL

[75] Inventor: J. Dewayne Allen, Paragould, Ark.

[73] Assignee: Allen Engineering Inc., Paragould, Ark.

[ * ] Notice: The term of this patent shall not extend beyond the expiration date of Pat. No. 5,480,258.

[21] Appl. No.: 499,746

[22] Filed: Jul. 7, 1995

Related U.S. Application Data

[63] Continuation-in-part of Ser. No. 176,118, Dec. 30, 1993, Pat. No. 5,480,258.

[51] Int. Cl.[6] ..... E01C 19/00

[52] U.S. Cl. ..... 404/112

[58] Field of Search ..... 404/96, 97, 112

[56] References Cited

U.S. PATENT DOCUMENTS

| | | | |
|---|---|---|---|
| 3,936,212 | 2/1976 | Holz, Sr. et al. | 404/112 |
| 4,046,484 | 9/1977 | Holz, Sr. et al. | 404/112 |
| 4,773,306 | 10/1988 | Kikuchi et al. | 404/112 X |
| 5,480,258 | 1/1996 | Allen | 404/112 |

*Primary Examiner*—William P. Neuder
*Attorney, Agent, or Firm*—Stephen D. Carver

[57] ABSTRACT

A high performance twin engine riding trowel for finishing concrete. A rigid frame mounts two downwardly projecting rotors that counter-rotate simultaneously. A guard cage mounted to the frame prevents inadvertent contact between the rotors and foreign objects. An operator sits in a seat mounted to the frame and steers the rotors with a pair of primary control levers that tilt the rotors to generate steering forces. The longitudinal pitch of the blades on each rotor is adjustable. Throttle controls are interconnected to synchronize the engines at low throttle and higher speeds. Illumination may be provided by lights mounted on the frame. Each engine slidably mounts a generally parallelepiped block attached to the frame. The engines counter-rotate while establishing generally coaxial, horizontal axes of rotation. Each engine drives a rotor through a belt system attached to a driveshaft. Both drive shafts establish generally coaxial axes of rotation that are generally parallel to the axes of rotation of the engines. Each driveshaft extends to a gearbox to transfer power to the rotor. U-joints on each of the drive shafts facilitate independent movement of the gearboxes. The gearboxes are interchangeable and mounted to tiltable, pivot able steering boxes secured to the frame by a top plate. Each rotor establishes a generally vertical axis of rotation. Several equidistantly spaced blades extend radially outward from each rotor. The blades contact plastic concrete to finish the surface while supporting the trowel.

9 Claims, 10 Drawing Sheets

HIGH PERFORMANCE TWIN ENGINE ROTOR-STEERED RIDING TROWEL

CROSS-REFERENCE TO RELATED APPLICATION

This application is a Continuation-in-Part of my prior patent application Ser. No. 08/176,118, filed Dec. 30, 1993, now U.S. Pat. No. 5,480,258, GAU 3506, entitled: Variable Width, Twin Engine Riding Trowel.

BACKGROUND OF THE INVENTION

I. Field of the Invention

The present invention relates generally to riding trowels used for finishing concrete surfaces. More particularly, the present invention relates to high powered, motorized riding trowels that are supported and steered by downwardly projecting, tiltable rotors. Known, representative self propelled riding trowels are classified in United States Patent Class 404, Subclass 112.

II. Description of the Prior Art

As will be recognized by those skilled in the art, motorized trowels can effectively finish large surface areas of wet concrete. Motorized riding trowels are particularly effective in this regard. Motorized "push trowels" and riding trowels often employ revolving rotors that directly contact the concrete surface. The rotors typically comprises a plurality of radially spaced apart finishing blades that revolve in frictional contact the with concrete surface. The rotors support the entire weight of the trowel. While a wide variety of manually pushed troweling machines or "power" trowels are currently used in the industry, self propelled riding trowels efficiently finish large areas of concrete more swiftly than motorized "push trowels."

During trowel finishing operations, the trowel must traverse the concrete surface several times as the concrete sets, and generally the more powerful the trowel, the faster the operation can be completed. In relatively recent years motor powered riding trowels have become popular. With riding trowels descended from Holz patents U.S. Pat. Nos. 4,046,484 and 3,936,212 steering and control is effectuated by the combination of rotor tilting and blade twisting. The rotors are driven by a self contained engine mounted on the frame that is linked to rotor gearboxes. A driver seated above the frame steers the trowel by tilting the axis of rotation of the rotors. The pitch of each trowel blade adjusts by pivoting about its longitudinal axis. A yoke controlled bearing assembly is often employed to vary the blade pitch.

Riding trowels typical of those present in the art are disclosed in two patents issued to Holz, U.S. Pat. Nos. 4,046,484 and 3,936,212. The latter patent depicts a three rotor trowel, while the former depicts an early twin rotor trowel. Both devices are powered by a single motor.

I have been involved with several prior motorized trowel inventions. U.S. Pat. No. 5,108,220 relates to a fast steering system for riding trowels. It discloses a state of the art steering system for riding trowels that enhances maneuverability and control. U.S. Pat. No. Des. 323,510 also discloses a riding trowel.

Kikuchi, U.S. Pat. No. 4,775,306, discloses a multiple engine trowel that does not use the rotors for propulsion or steering. This device is not the type of trowel pioneered by Holz listed above. A pair of drum-like crawlers are separately employed to support the trowel, and they are powered for locomotion. The blades define a wiping annulus upon the concrete surface that circumscribes the crawlers. An unfinished area within the wiping blade perimeter results, and energy is wasted as the frictional contact of the blades is merely dissipated as heat rather than providing propulsion or steering.

Most current riding trowels in the Holz species employ two sets of bladed rotors. The sweep areas of the rotor blades often overlap to avoid intermediate seams or surface blemishes. In other words, the propeller-like blades properly mesh to avoid unfinished boundary strips. With relatively larger diameter surface finishing pans, no overlap occurs. Typically such rotors must rotate at the same speed to prevent blade collision. Known current trowels use a single engine that ensures that the rotors are properly synchronized. However, a relatively slow finishing speed results from the low power output of single engine designs. Since concrete must be finished before setting, the finishing speed of the trowel is important.

At very large pour cites it is often difficult to finish all of the concrete surface area before the concrete significantly sets. Thus more powerful riding trowels are continually evolving. Typical single engine machines are being equipped with more and more powerful engines.

However, bigger engines can result in problems. A very large engine makes structural demands on the frame, the rotors and the drive train. Obviously, because the rotors are in direct wiping contact with the concrete surface being treated, a typical twin rotor trowel is already under considerable stress. One problem is caused by the transmission of vibrations from the blades to the dynamic components and drive train of the trowel. Vibrations can easily damage the engines, which are expensive to repair. Since contra-rotation of the rotors is typical, preservation of mechanical symmetry in the critical motor-to-rotor gearbox system with a single engine is a challenge yet to be solved.

On multiple rotor trowels, it is desirable to substantially isolate the individual rotors and their gearboxes from the other rotors and gearboxes. Therefore, when one rotor or gearbox breaks, the other rotors and gearboxes are hopefully undamaged. However, single engine designs are deficient in this respect. For example, damaging stresses resulting from impact of one rotor with an "immovable object" are often transmitted to the other rotor drive train with typical older designs.

Obviously trowel breakdown during critical concrete setting necessitates immediate repairs at the job sight. Since one of the most routinely troublesome components is the gearbox, an interchangeable gearbox that would fit any of the rotors on a multiple rotor trowel would diminish down time. An interchangeable gearbox would decrease the quantity of spares that must be kept in stock for repairs.

To minimize problems with powerful self propelled riding trowels I have proposed a twin engine design in my copending application referenced above. In this application I have improved the engine mounting scheme, the power train, and the overall design, after extensive product testing, so as to maximize reliability.

SUMMARY OF THE INVENTION

The instant riding trowel has been designed to maximize horsepower and speed, while preserving reliability and control. The present design allows an operator to efficiently finish a large area of plastic concrete. The trowel uses two engines to substantially independently distribute its inherently higher horsepower. Because power is distributed from two separate engines through separate substantially disparate drive train halves, the chances that forces impacting one blade or rotor can damage the opposite blade or rotor are minimized.

The preferred trowel comprises a rigid metal frame that mounts separate high-power, preferably internal combustion engines. Because the engines are symmetrically spaced apart upon the frame, a dynamic balance is achieved that contributes to ease of use and steering control. Each engine drives a bladed rotor in contact with the concrete surface that counter-rotate simultaneously. A guard cage mounted to the frame prevents inadvertent contact between the rotors and foreign objects.

The seated driver steers the trowel with primary control levers that tilt the rotors to generate steering forces. The longitudinal pitch of the blades on each rotor is also adjustable. Other controls available to the operator include engine switches and gauges. Illumination may be provided by lights mounted on the frame.

Each engine slidably mounts a generally parallelepiped block attached to the frame. The engines counter-rotate while establishing generally coaxial axes of rotation. Each engine drives a pulley. The pulley drives several fan belts that turn a drive shaft. Each engine may be slightly adjusted to tension the belts while maintaining the overall coaxial alignment of each axes of rotation.

Both drive shafts cooperatively establish generally coaxial axes of rotation that are generally parallel with the axes of rotation of the engines. The drive shaft and respective belts operationally connect a gearbox to the engine. Each drive shaft extends between the gearbox and the belts. U-joints on each of the drive shafts permit the gearbox and the rotor to move relative to their respective engine. The fan belts and the U-joints cooperatively prevent sudden shocks from being transmitted from the blades to the engines.

Preferably, the gearboxes are interchangeable to promote efficiency when servicing the trowel. The gearboxes are mounted to tiltable, pivot able steering boxes secured to the frame by a top plate. A rotor is secured to a shaft extending downwardly from each gearbox. Several equidistantly spaced blades extend radially outward from each rotor. The blades frictionally contact the concrete surface to be finished while supporting the trowel and operator.

The pitch of the blades attached to each rotor may be varied by a tubular handle assembly or electric linear actuator. The handle or actuator is connected to a cable extending to a pivoting fork which contacts and actuates a swash plate. Arms extend from each rotor blade. The swash plate deflects the arms to vary each blade's pitch by twisting them radially about their longitudinal axis. The pitch of the blades determines the finish applied to the concrete surface, and it can also vary steering and control.

Portions of the steering system are described in part in my prior U.S. Pat. No. 5,108,220 that relates to a fast steering system for riding trowels, which is hereby incorporated by reference. Preferably a pair of parallel lever arms beneath the frame are connected to the driver's control levers. Each arm is connected to a torque rod coupled to a gearbox. The controls thus transmit tilting forces to the rotors for steering and control. A synchronizer, preferably associated with the throttle, controls the engines. The synchronizer ensures that the engine low idle and high speeds are generally matched.

Therefore, it is a primary object of my High Performance Twin Engine Rotor-Steered Riding Trowel is to provide a dynamically-balanced trowel that finishes a large area of concrete efficiently and quickly.

An object of the present invention is to provide a trowel of the character described that is inherently stable and easy to control and steer.

Another object is to provide a trowel that is well suited for confined job sites.

Another object of the present invention is to provide a trowel that uses multiple engines to simultaneously rotate multiple rotors to finish concrete.

A basic object of the invention is to provide a multiple engine and multiple rotor trowel that distributes engine weight and power evenly to each rotor.

More particularly, it is an important object of my new riding trowel to distribute engine weight virtually directly upon each corresponding rotor so that steering and control are not abrogated by unbalanced engine forces directed to the rotors and acting upon the frame.

Yet another important object is to provide a multiple motor trowel wherein each rotor gearbox is independently driven.

A related object is to provide a multiple motor trowel that tends to isolate each rotor from shocks experienced by the other.

Another basic object of the present invention is to provide a riding trowel that increases production.

A related object is to provide a riding trowel that is particularly well suited for use on quick curing concrete jobs.

Another basic object of the invention is provide interchangeable gearboxes to prevent breakdowns and promote efficient service of the trowel.

An object of the invention is to provide a sectioned driveshaft that permits the gearbox to move relative to the engine to prevent vibrations from being transmitted from the rotors to the engine.

Another object of the present invention is to provide a multiple rotor trowel wherein the rotors function individually.

These and other objects and advantages of the present invention, along with features of novelty appurtenant thereto, will appear or become apparent in the course of the following descriptive sections.

BRIEF DESCRIPTION OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION

Figure 1:
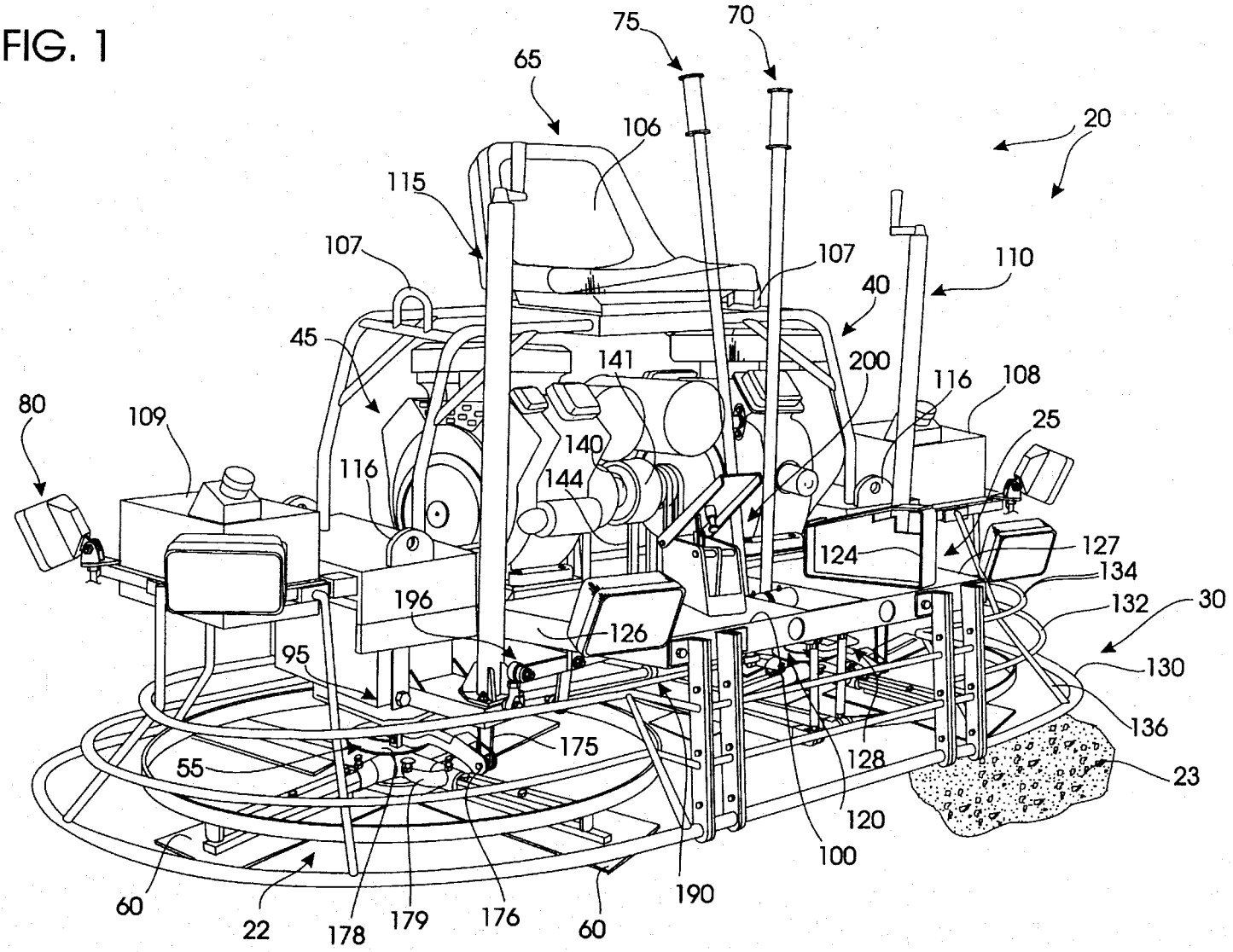
FIG. 1 is a front, environmental, isometric view of my High Performance Twin Engine Rotor-Steered Riding Trowel, showing the best mode of my invention.

With attention now directed to the accompanying drawings, my Light Weight Multiple Engine Riding Trowel is broadly designated by the reference numeral 20. The trowel 20 comprises a metal frame 25 surrounded by a guard cage 30 (FIGS. 1–5) that is supported above a concrete surface 23 to be finished by a pair of rotor assemblies 50, 55. The frame 25 mounts a pair of displaceable engines 40, 45 that drive counter-rotating, rotor assemblies 50, 55. The engines 40, 45 also counter-rotate. The axis of rotation of each engine 40, 45 is generally coaxial with the other. Each of the engines 40, 45 is journalled to one of the rotor assemblies 50, 55, respectively.

Several radially spaced apart blades 60 extend outwardly from each of the rotors 50, 55. The blades 60 frictionally contact the concrete surface 22 to be finished and support the trowel 20 and the operator. An operator station 65 mounts the top of the frame.

Figure 2:
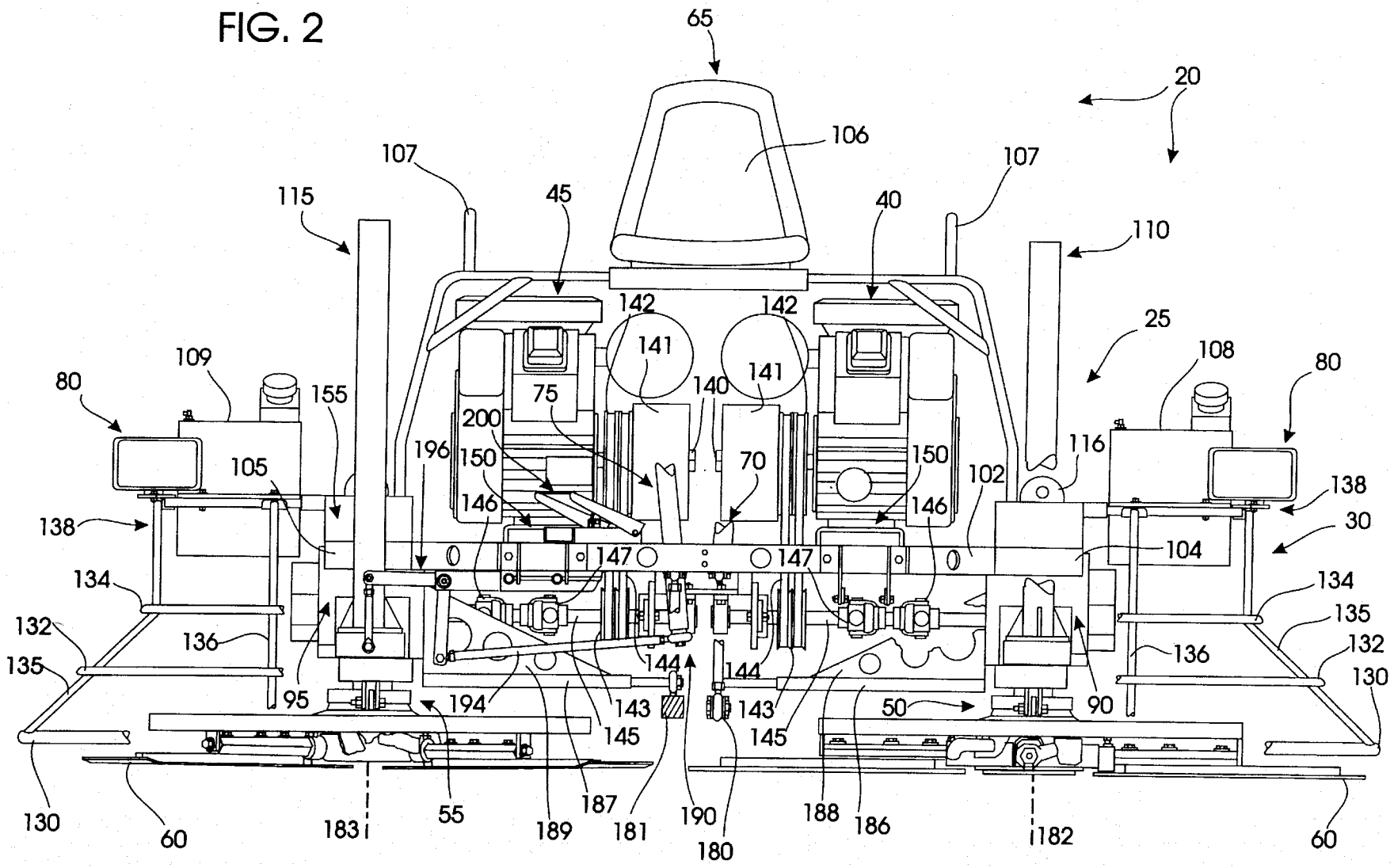
FIG. 2 is a fragmentary front elevational view with portions omitted and/or broken away for clarity.
Figure 5:
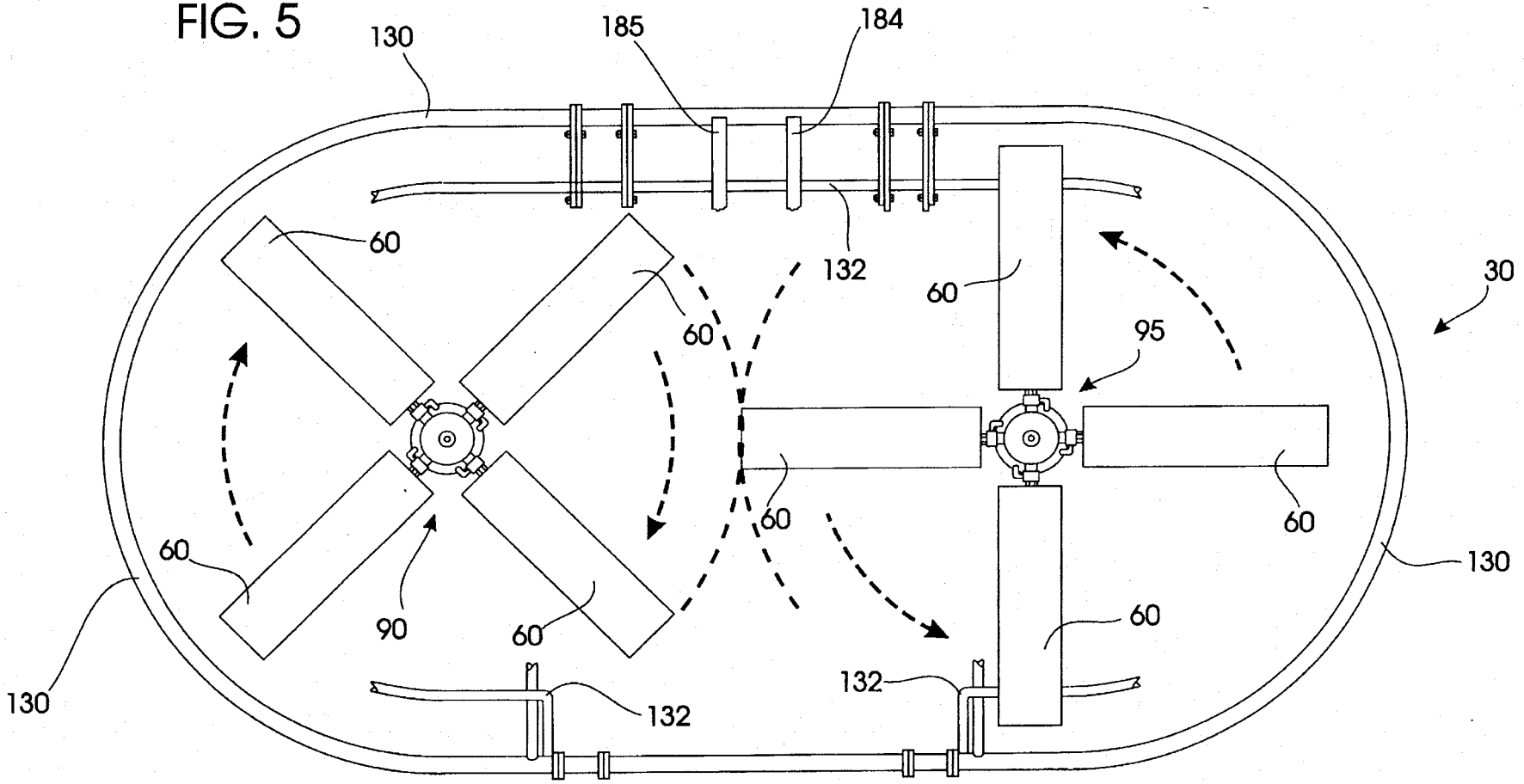
FIG. 5 is a fragmentary, bottom plan view of my trowel illustrating the overlap between sweeps of the rotors, with portions omitted for clarity.
Figure 6:
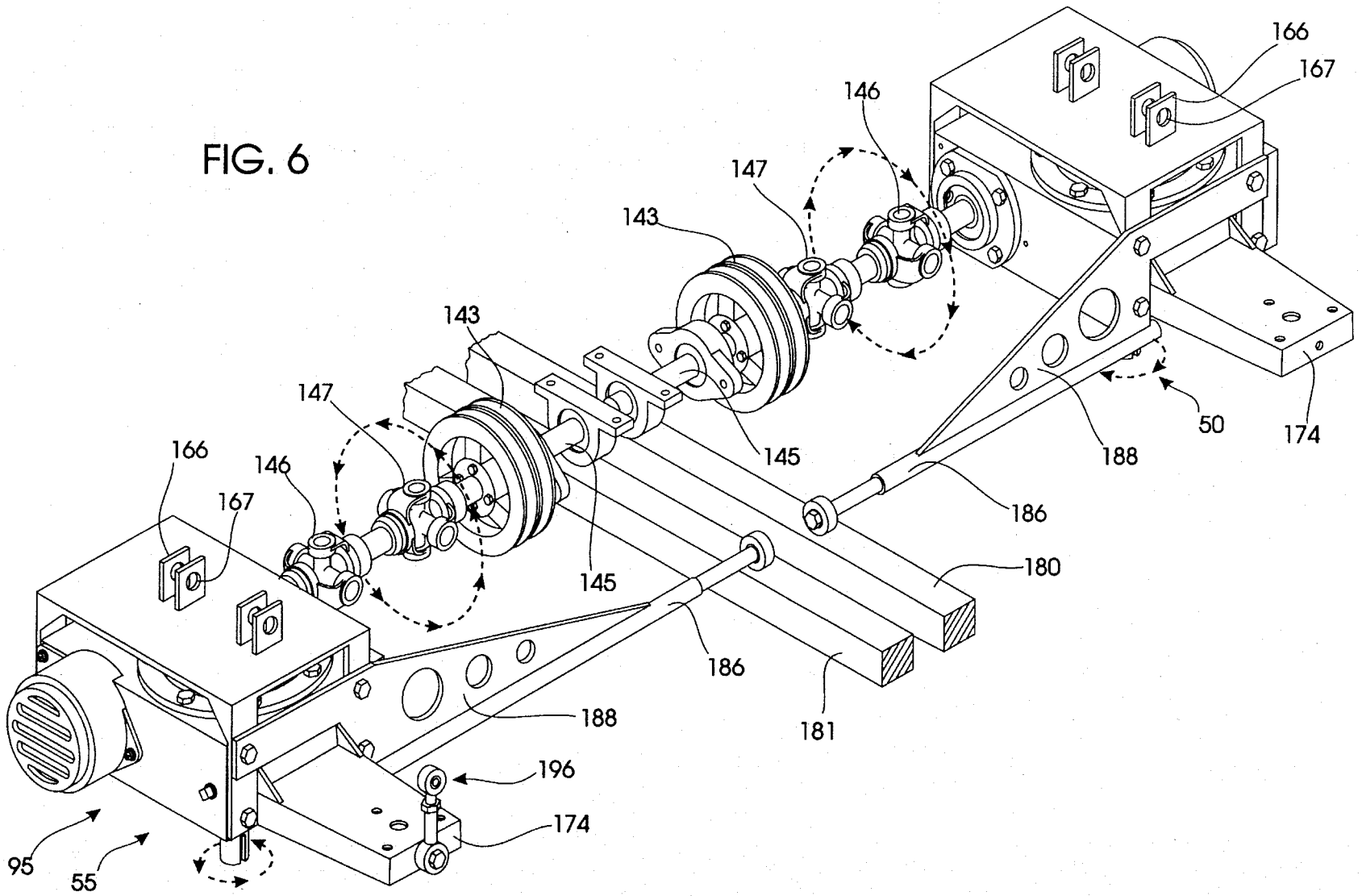
FIG. 6 is an enlarged, fragmentary front isometric view, with portions omitted for clarity, showing sections of the trowel steering and drive train.

The controls are easily reached by a seated operator at the station. As viewed by a seated operator, the left rotor 50 revolves in a counterclockwise direction, and the right rotor 55 revolves in a clockwise direction (FIGS. 5 and 6). The operator steers the trowel 20 with two primary control levers 70, 75 (FIGS. 1 and 2). The levers 70, 75 manipulate gearboxes 90, 95. The gearboxes 90, 95 control the angle or degree of tilt of the rotors 50, 55 to generate steering forces. The longitudinal pitch of each blade 60 may also be manipulated, either manually or electrically, to further control the trowel 20 and the finish imparted to the concrete surface 22 (FIGS. 1, 2 and 5).

Auxiliary lights 80 attach to the frame to provide illumination when necessary. Preferably, the lights bolt to the guard cage 30 to ease their replacement or positioning. Preferably, the guard cage 30 bolts to the frame 25 to facilitate removal or replacement of damaged sections.

The frame 25 comprises an upper deck 100 supported by front and rear frame members 102, 103 and ends 104, 105. The upper deck 100 covers the front and rear members 102, 103. The upper deck provides a mounting surface and a treading platform for an operator. A seat 106 and handholds 107 permit the operator to mount and ride the trowel. Conventional engine controls and gauges (not shown) are conveniently mounted adjacent the seat 106. Two gas tanks 108 and 109 are mounted adjacent the ends 104, 105 for convenient fill-ups. Tubular handles 110, 115 or electronic controls are employed by the operator to vary the pitch of the blades 45. Tabs 116 project from the frame to facilitate lifting or transportation of the trowel 20.

A forward subframe 120 projects from the frame 25. It mounts the primary control levers 70, 75, a throttle pedal 200, and a foot rest 124. The subframe 120 comprises sides 126, 127 angularly extending forwardly from the front frame member 102. A front cross member 128 defines the front of the trowel. The upper deck 100 also covers the subframe 120.

The guard cage 30 comprises an oval ring 130 that is offset from the concrete surface 22. Reinforcement, guard bars 132, 134 are spaced apart and above the lower ring 130. Radially spaced apart reinforcement spokes 135, 136 extend between the ring 130, bars 132, 134 and frame deck 100. The spokes 135, 136 bolt to the frame with bolts and nuts 135A, 136A to ease replacement or removal of sections of the guard 30. The end spokes 135 are coupled to the frame 25 by end assemblies 138 disposed on the ends 104, 105 of the frame 25. Preferably, the end assemblies 138 bolt to the frame with bolts 138A to promote their removal or repair.

The engines 40, 45 are preferably horizontal shaft internal combustion engines. The engines 40, 45 counter-rotate. The axis of rotation of each engine 40, 45 is generally coaxial with the other. Each engine 40, 45 and its respective, coupled gearbox 90, 95 and rotor 50, 55 are mounted similarly. Therefore, only one engine 45 coupled to one gearbox 95 and rotor 55 will be discussed in detail. The gearbox 95 will be discussed in more detail hereinafter.

The output shaft 140 of the engine 45 drives a clutch 141 controlling a pulley 142 (FIG. 2) which is connected to an input shaft pulley 143 by fan belts 144. Belts 144 can slip to prevent engine damage. The belts 144 also permit the engine 45 to be displaced slightly forwardly or rearwardly without altering the driveshaft or gearbox positions. The shaft 140 of each engine 40, 45 establishes an axis of rotation. The axes of rotation of both engines 40, 45 are generally coaxial.

Figure 7:
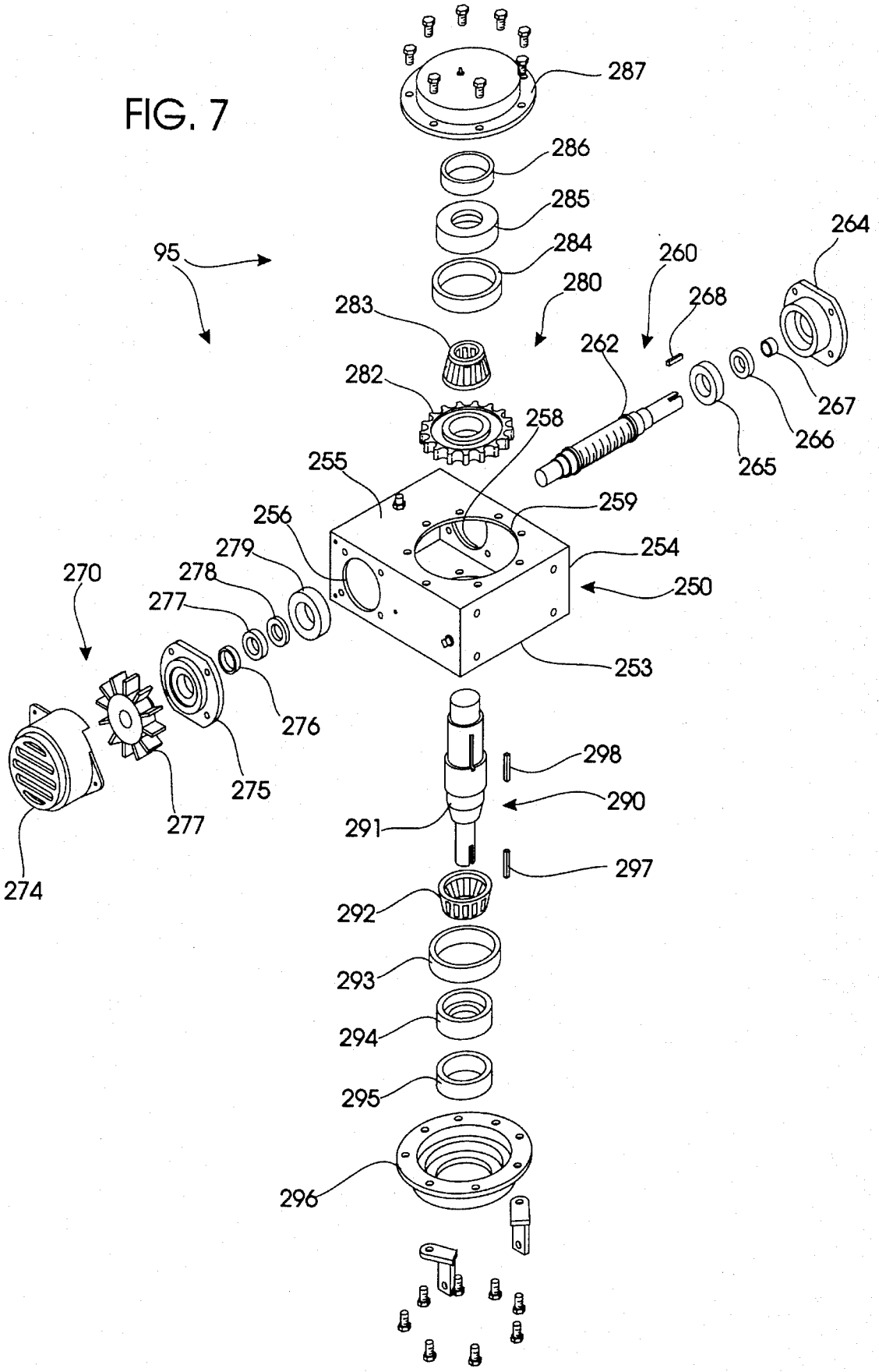
FIG. 7 is an exploded fragmentary front isometric view of the left gearbox, with portions omitted for clarity.
Figure 8:
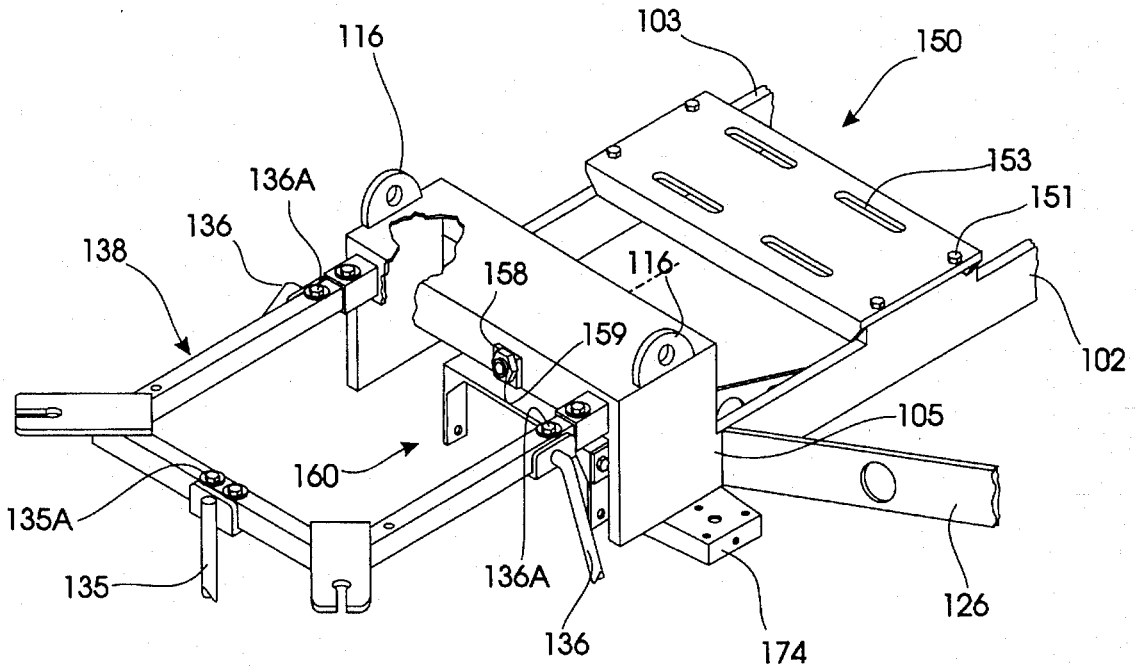
FIG. 8 is a fragmentary front isometric view, with portions omitted for clarity, showing the position of the engine mount and gearbox.

The fan belts 144 extend downwardly from the pulley 142 to a driveshaft 145. Driveshaft 145 extends to a gearbox 95 (FIGS. 6 and 7). The drive shafts counter-rotate with respect to one another to establish an axis of rotation that is generally coaxial with the other driveshaft. The axes of rotation of the drive shafts are generally parallel to the axes of rotation of the engines.

The driveshaft 145 is split by two U-joints 146, 147. The U-joints 146, 147 allow slight, operational displacements of the gearbox 95 relative to the input shaft pulley 143. The "slack" in the driveshaft 145 is necessary to help prevent vibrations from being transmitted to the engine 45. Since the blades 60 are generally made of metal, they do not absorb jars or shocks caused when the trowel finishes the concrete.

Engine mount 150 supports engine 45 (FIGS. 5 and 6). The engine mount 150 secures to front and rear members 102, 103 adjacent end 105. Bolts 151 pass through orifices 152 in the engine mount 150. Raised tabs 151A on members 102, 103 secures the mount 150. Tab orifices 152A receive bolts 151. Slots 153 permit the engine 45 to be slightly displaced forwardly and rearwardly on the mount 150 to tension the belts.

A gearbox block 155 secures immediately adjacent end 105. The block 155 is secured to the by a nut 158 and bolt 158A passing through orifices 159 defined in the block 155. The gearbox block 155 is pivotally secured to a generally parallelepiped gearbox top plate 160. Thus, each gearbox 90, 95 is pivotally mounted to the frame 25. Also, gearbox 90 and 95 are interchangeable to promote efficiency in repairs and manufacture of the gearboxes, as is discussed in more detail hereinafter.

The preferred steering system is discussed in greater detail in my previous U.S. Pat. No. 5,108,220, the disclosure of which is hereby incorporated by reference. In the present invention, gearbox 95 is mounted to the underside of block 155 by a tiltable, pivot steering box 161. How a gearbox tilts is established by connection of its pivot steering box 161 to the block 155 (FIG. 6). Pivot steering box 161 allows its gearbox 95 to tilt right to left and front to back, whereas the opposite steering box allows the gearbox 90 to tilt only right and left. The pivot steering boxes 161 are structurally identical. They are mounted differently for steering purposes.

Figure 9:
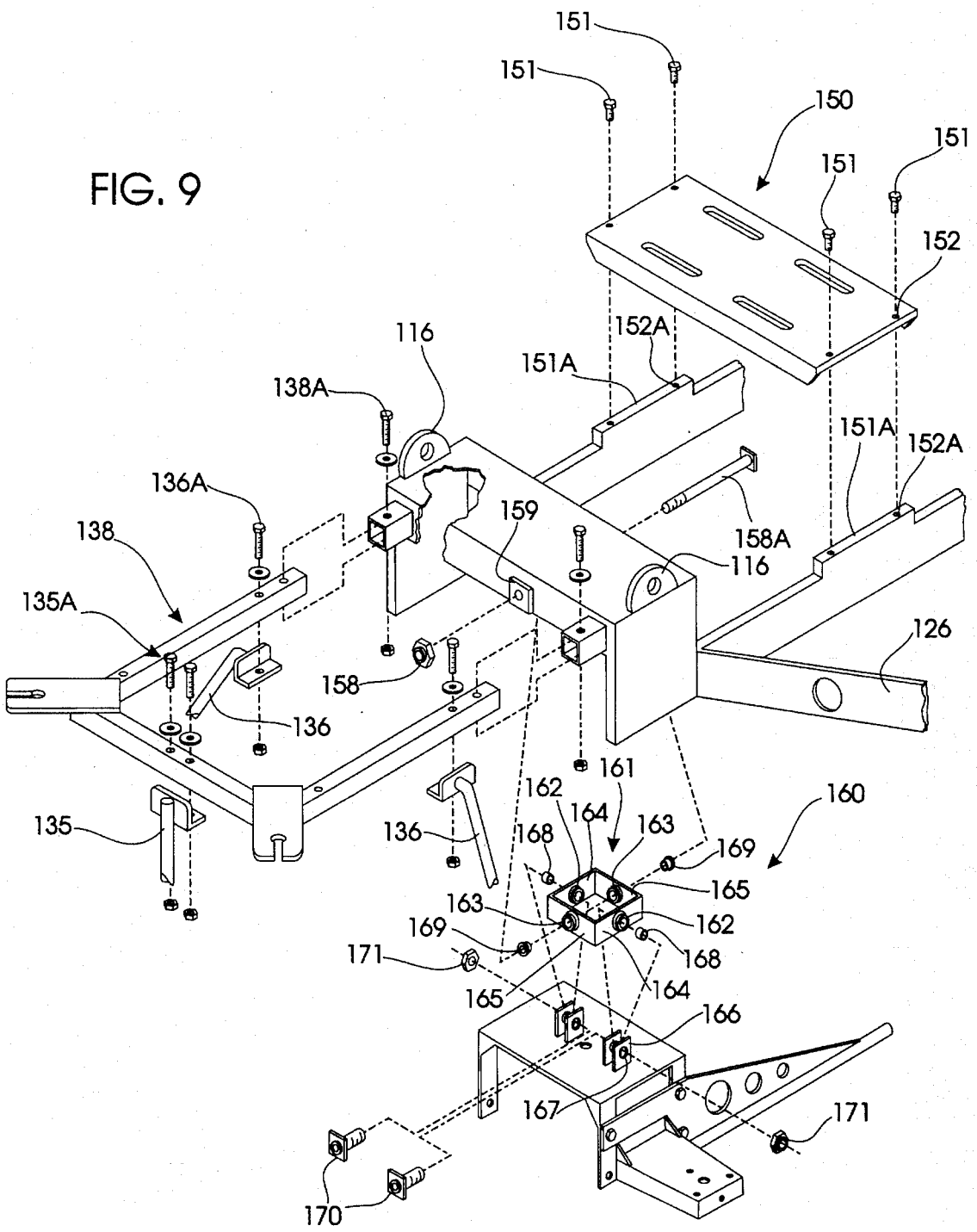
FIG. 9 is an exploded fragmentary front isometric view, with portions omitted for clarity.
Figure 10:
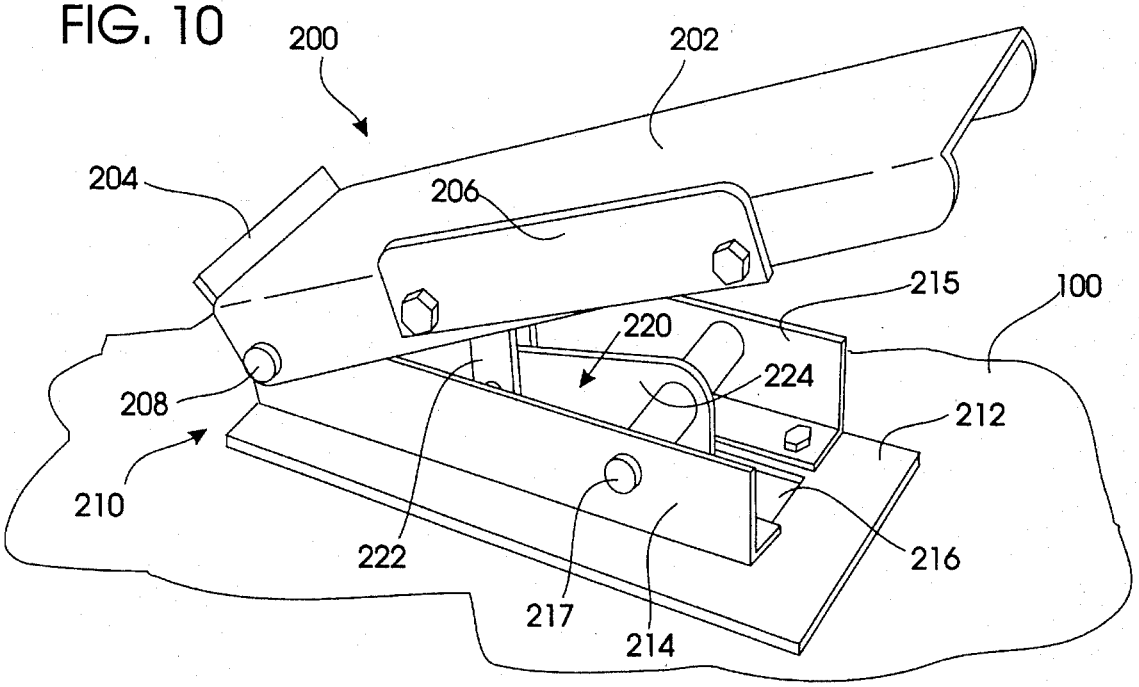
FIG. 10 is an enlarged, front isometric view of the throttle assembly.
Figure 11:
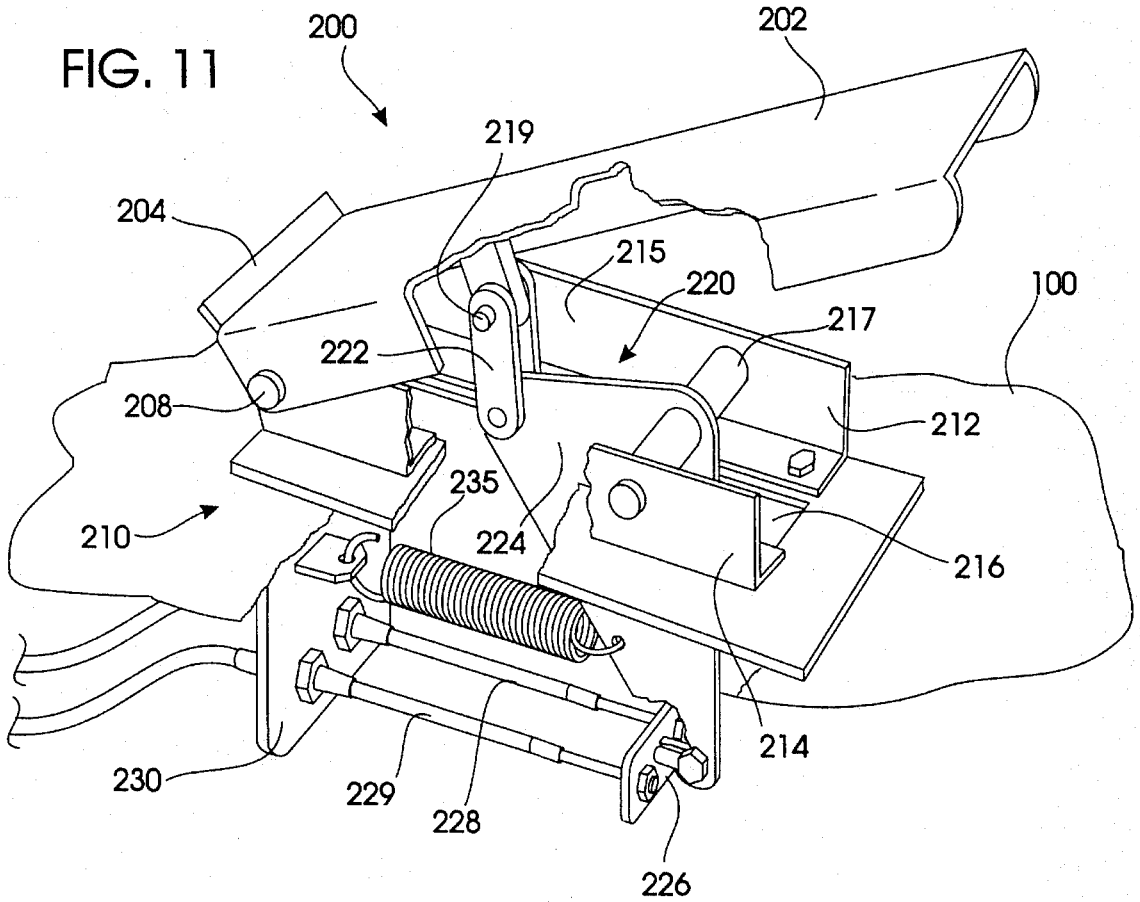
FIG. 11 is a fragmentary front isometric view similar to FIG. 7, with portions omitted for clarity.

The crosshead pivot steering boxes 161 (FIG. 9) are generally square. Bearing mandrels, defining orifices 162, 163 are formed in the front, back and sides 164, 165 of the crosshead boxes 161. The top plate 160 of the gearbox 95 includes twin pairs of upwardly rising nubs 166. The nubs 166 are penetrated by aligned orifices 167 that register with bearing orifices 162. Bearings 168 are captivated between the hubs 166 within the bearing orifices 162. Reinforced bearings 169 fit between reinforced orifices 163 defined in the steering box sides 165 and extend into block orifices 159. Bolt 158A penetrates reinforced orifices 159 and box orifices 163. Bolts 170 penetrate nubs 166 and box orifices 162. The bolts 158A and 170 suspend steering box 161 for pivotal movement. Each bolt 170 is retained by a self locking nut 171. Pivoting about bolt 158A results in gearbox movement in a forward and back arc. Pivoting about bolts 170 results in gearbox movement in an arc from side to side.

The pivot steering box on gearbox 90 is mounted exactly as described above with the addition of a pair of bolts passing through each side of the block. These bolts are threaded into orifices drilled in the sides of the steering box. These bolts prevent rotation about the pivot bolt 159A, thereby only permitting this side to side movement of gearbox 90.

The rotor 55 is secured to a shaft extending downwardly from the gearbox 95 as disclosed in greater detail in the aforementioned patent (FIGS. 1 and 2). Tubular handle assemblies 70, 75 or electric linear actuators, controlled by the operator are employed to vary the pitch of the blades 60. These assemblies 70, 75 are mounted on a ledge 174 extending from the associated gearbox top plate 160. The assemblies 70, 75 each control a cable 175 extending to a pivoting fork 176 which contacts and actuates a swash plate 178. The swash plate 178 contacts an arm 179 extending from each blade 60, deflecting the blade 60 to the desired pitch.

Figure 3:
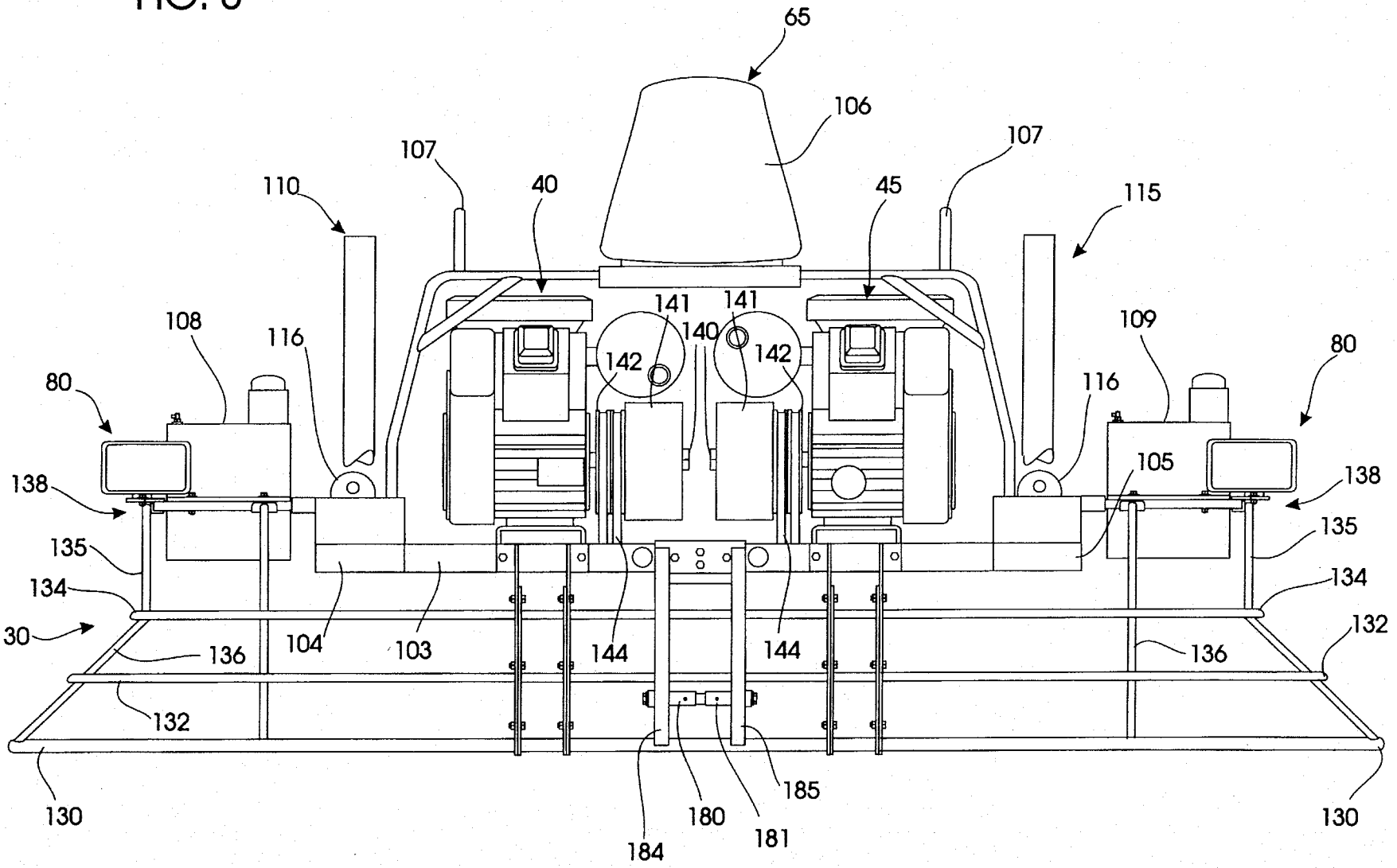
FIG. 3 is a fragmentary rear elevational view, with portions omitted and/or broken away for clarity.
Figure 4:
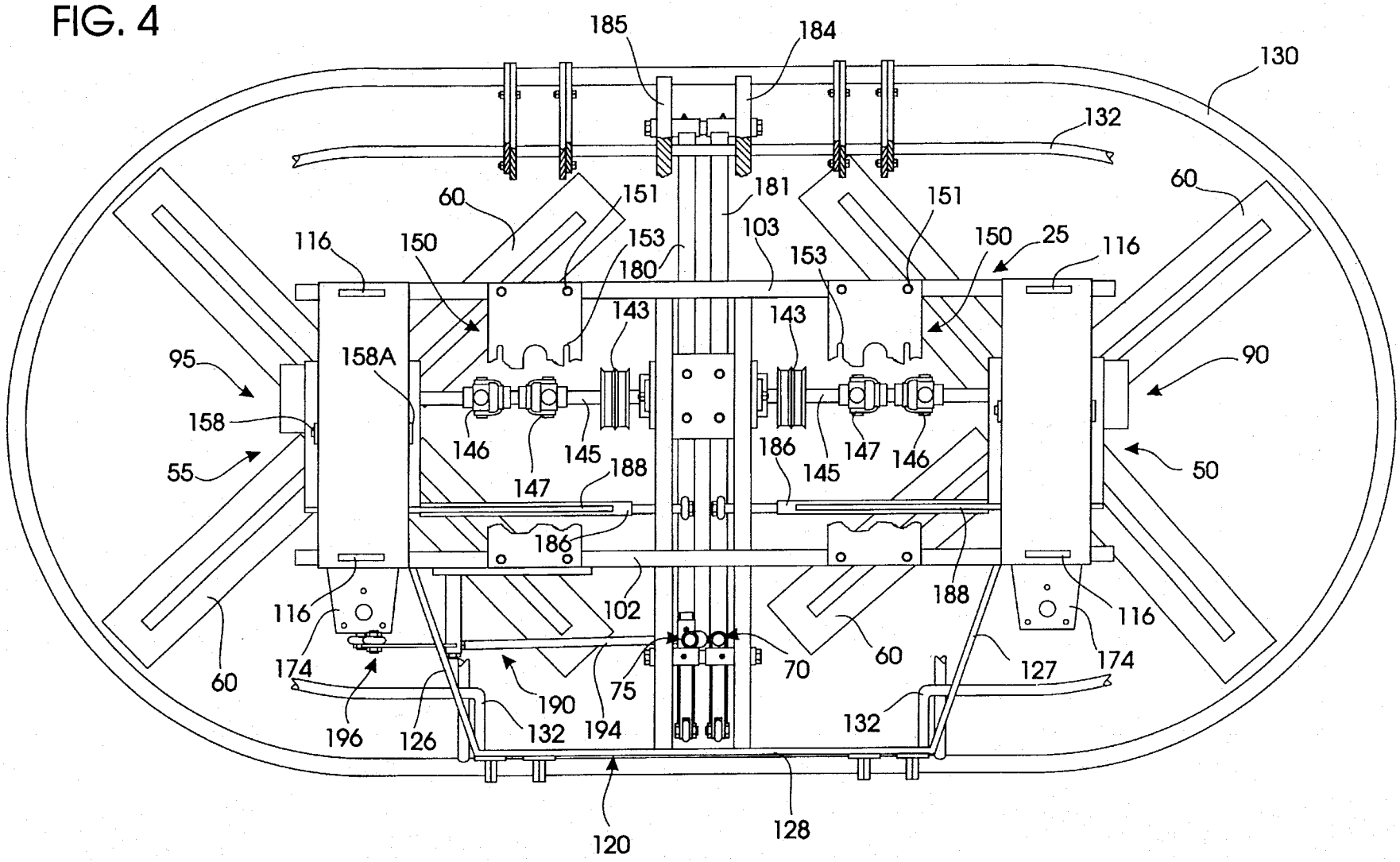
FIG. 4 is a fragmentary, top plan view illustrating the preferred drive train, with portions omitted for clarity.

Parallel lever arms 180, 181 extend beneath the frame 25 in a direction generally perpendicular to the biaxial plane defined by the rotor axes 182, 183. The arms 180, 181 are pivotally anchored to inclined struts 184, 185 extending from the rear frame member 103 (FIG. 3). The arms 180, 181 may be deflected by the primary control levers 70, 75 (FIGS. 1—3). Each arm 180, 181 activates elongated torque rods 186, 187 coupled to the gearboxes 90, 95 to tilt the rotors 50, 55 in a plane parallel with the biaxial plane.

The torque rods 186, 187 are generally aligned and extend along the bottom of gussets 188, 189 projecting from the gearboxes. The rods 186, 187 are also offset from the axis of rotation defined within the steering boxes as disclosed in the above referenced patent. The right rotor 55 also tilts in an arc perpendicular to the biaxial plane. The right control lever 75 controls a tertiary linkage 190 comprising a torque shaft 194 interconnected with a "C" shaped crank 196 that tilts rotor 55 in a plane perpendicular to the biaxial plane.

A synchronizing throttle peddle 200 controls the flow of fuel from the gas tanks 108, 109 to the engines 40, 45 to ensure that the rotors 50, 55 rotate substantially uniformly. It is important that motor speed be generally the same, but absolute synchronization is not mandatory since the rotor blades do not mesh with one another.

The peddle assembly 200 comprises a planar foot rest 202. The foot rest 202 is bounded at its lower end by an upturned lip 204. A bracket 206 extends above the plane of the rest 202 to prevent the operator's foot from slipping off the side of the rest. A pin 208 pivotally attaches the foot rest 202 to the assembly undercarriage 210.

The undercarriage 210 comprises a slotted base 212 penetrated by a throttle spring assembly 220. Two parallel spaced apart, elongated brackets 214, 215 mount along the slot 216. The foot rest pins into one end of the brackets 214, 215. The spring assembly 220 attaches near the opposite bracket ends. A pin 217 permits the spring assembly 220 to pivot. A tab 219 depends from the bottom of foot rest 202. The tab 219 is received by a boss 222 that extends to and pivotally attaches to a master plate 224. The master plate 224 is penetrated by pin 217 and pivots thereabout. The bitter end of the plate 224 is attached to a transverse plate 226. The throttle control lines 228, 229 for engines 40, 45 are both attached to the plate 226. Thus, when plate 226 moves, both throttle control lines move. Therefore, both engines operate at the same speed at all times.

A spaced apart, parallel back plate 230 maintains tension in the throttle control lines 228, 229. A spring 235 extends between the back plate 230 and the transverse plate 226 to bias the master control plate in a closed position.

Often the trowel 20 requires on site maintenance. An especially troublesome component on most trowels is the gearbox. Therefore, the preferred gearboxes on trowel 20 are interchangeable. In other words, gearbox 90 and gearbox 95 are substantially identical. This interchangeability means that the trowel may be more efficiently maintained because only one spare must be stocked to service either gearbox. Since gearbox 95 is identical to gearbox 90, only one gearbox will be detailed.

Gearbox 95 comprises a housing 250 that protectively encloses most of the internal components (FIGS. 6, 7). Housing 250 comprises a box-like structure having a pair of opposing sides 252, 254. Sides 252, 254 are penetrated by two aligned, opposing orifices 256, 258. Orifices 256, 258 receive the worm gear assembly 260 and the fan assembly 270 respectively. The worm gear assembly 260 comprises worm gear 262 that is mounted to the housing by a gearbox flange 264. A series of progressively smaller sleeves 265, 266, 267 appropriately space the worm gear in flange 264. A key 268 locks the worm gear to the drive shaft 145.

The fan assembly 270 comprises a fan 272 mounted externally on housing 250. A protective shroud 274 covers fan 272. A flange 275 rotatably attaches the fan 272 to the housing 250. A series of sleeves 276, 277, 278 & 279 ensure the proper spacing of the fan in flange 275. The housing bottom 253 and top 255 are also penetrated by a pair of aligned, opposing orifices 257, 259. Orifices 257, 259 receive the gear assembly 280 and rotor assembly 290 respectively.

The gear assembly 280 comprises a main gear 282 mounted in housing 250. Gear 282 is driven by worm gear 262. Gear 282 is supported by a cone bearing 283. Gear 282 is properly spaced by a series of sleeves 284, 285 and 286. A cover 287 retains and seals the gear assembly within the housing 250.

The rotor assembly 290 comprises a main shaft 291 supported by a cone bearing 292. The shaft attaches to housing 250 by a flange 296. A series of sleeves 293, 294 and 295 properly space shaft 291 within flange 296. A key 297 locks shaft 291 to rotor 55. A second key 298 locks shaft 291 to gear 282.

From the foregoing, it will be seen that this invention is one well adapted to obtain all the ends and objects herein set forth, together with other advantages which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A motorized riding trowel for finishing a concrete surface, said riding trowel comprising:

a frame;

a pair of motors mounted on said frame for powering said riding trowel, each motor establishing an axis of rotation, and the axis of rotation of each motor being substantially coaxial;

a pair of spaced apart rotors depending downwardly from said frame for frictionally contacting said concrete surface and supporting said frame thereabove, each of said rotors driven by one of said motors and establishing a generally vertical axis of rotation;

a pair of separate drive shafts, one drive shaft projecting from each of said rotors towards one another, the axis of rotation of each drive shaft being substantially coaxial with one another and generally parallel with the axis of rotation of each motor; and, means for independently rotatably coupling said drive shafts to said motors.

2. The riding trowel as defined in claim 1 further comprising displaceable motor mount means for adjustably mounting said motors to said frame.

3. The riding trowel as defined in claim 2 wherein said means for rotatably coupling said drive shafts to said motors comprises belt means extending between said motors and said drive shafts and belt tensioning means for tensioning said belts.

4. A self-propelled, motorized riding trowel with multiple engines for finishing a concrete surface, said riding trowel comprising:

at least two spaced apart motors for powering said riding trowel;

seat means for supporting an operator of said riding trowel;

control means accessible by said operator from said seat means for steering said riding trowel;

frame means adapted to be disposed over said concrete surface for supporting said seat means, said control means and said motor means;

at least two spaced apart, rotors driven by and associated with each of said motors, said rotors attached to said frame means to frictionally contact said concrete surface while supporting said frame means thereabove, each rotor establishing a generally vertical axis of rotation;

peddle means mounted on said frame means for concurrently controlling said motors to simultaneously rotate all of said rotors.

5. The riding trowel as defined in claim 4 further comprising displaceable motor mount means for adjustably mounting said motors to said frame.

6. The riding trowel as defined in claim 5 including guard cage means for preventing inadvertent contact between said rotor means and foreign objects, said guard cage means mounted on said frame means.

7. The riding trowel as defined in claim 6 including: a drive shaft projecting from each of said rotors towards one another, the axis of rotation of each drive shaft being substantially coaxial with one another and generally parallel with the axis of rotation of each motor; and, means for rotatably coupling said drive shafts to said motors.

8. The riding trowel as defined in claim 7 wherein said means for rotatably coupling said drive shafts to said motors comprises belt means extending between said motors and said drive shafts and belt tensioning means for tensioning said belts.

9. A self-propelled, dual motor riding trowel for finishing a concrete surface, said riding trowel comprising:

a rigid frame adapted to be disposed over said concrete surface;

seat means on said frame for supporting an operator of said riding trowel;

a pair of spaced apart rotors projecting downwardly from said frame for frictionally contacting said concrete surface and supporting said frame thereabove, each rotor establishing a generally vertical axis of rotation and comprising a plurality of revolving blades that contact and finish concrete, the blades having a longitudinal axis about which they may be rotated to vary their pitch;

a motor disposed upon said frame above each of said rotors for revolving the rotors to finish concrete and propel said riding trowel, each motor establishing a generally horizontal axis of rotation, each axis of motor rotation being substantially collinear with the other;

a separate drive shaft operationally coupling each motor to each rotor, the drive shafts being axially aligned with one another and generally parallel with the axis of rotation of the motors;

throttle means synchronizing said motors, said shaft means extending substantially horizontally between said rotors beneath said seat means and oriented substantially parallel to each axis of rotation;

belt means interconnecting each motor with said driveshafts whereby to power said rotors; and, control means accessible by said operator from said seat means for activating the rotors and said blades to effectuate steering and control of said riding trowel.

* * * * *